US011247222B2

(12) United States Patent
Alluigi

(10) Patent No.: US 11,247,222 B2
(45) Date of Patent: Feb. 15, 2022

(54) CONNECTION SYSTEM BETWEEN A BOTTLE AND A DISPENSING HEAD

(71) Applicant: Guala Dispensing S.p.A, Spinetta Marengo (IT)

(72) Inventor: Riccardo Alluigi, Spinetta Marengo (IT)

(73) Assignee: GUALA DISPENSING S.P.A., Spinetta Marengo (IT)

( * ) Notice: Subject to any disclaimer, the term of this patent is extended or adjusted under 35 U.S.C. 154(b) by 0 days.

(21) Appl. No.: 16/633,631

(22) PCT Filed: May 15, 2018

(86) PCT No.: PCT/IB2018/053384

§ 371 (c)(1),
(2) Date: Jan. 24, 2020

(87) PCT Pub. No.: WO2019/021069

PCT Pub. Date: Jan. 31, 2019

(65) Prior Publication Data

US 2021/0086213 A1 Mar. 25, 2021

(30) Foreign Application Priority Data

Jul. 26, 2017 (IT) ..... 102017000085464
Dec. 12, 2017 (IT) ..... 102017000143091

(51) Int. Cl.
*B05B 11/00* (2006.01)

(52) U.S. Cl.
CPC ..... *B05B 11/3045* (2013.01); *B05B 11/3057* (2013.01)

(58) Field of Classification Search
CPC ..... B05B 11/001; B05B 11/3011; B05B 11/3045; B05B 11/3049; B05B 11/3057;
(Continued)

(56) References Cited

U.S. PATENT DOCUMENTS 3,917,097 A * 11/1975 Uhlig ..... B65D 50/046 215/216
4,069,942 A * 1/1978 Marshall ..... B65D 50/046 221/4

(Continued)

FOREIGN PATENT DOCUMENTS

EP 0176206 A2 4/1986
EP 0867230 A2 9/1998

(Continued)

OTHER PUBLICATIONS

International Search Report and Written Opinion for International Patent Application No. PCT/IB2018/053384, dated Aug. 22, 2018, 9 pages.

*Primary Examiner* — Patrick M. Buechner
(74) *Attorney, Agent, or Firm* — Armstrong Teasdale LLP

(57) ABSTRACT

A connection system between a head and a bottle of a trigger dispensing device includes a main skirt having a first flexible tab and a neck (2*b*) having a first sloping plane and a first pocket. The first flexible tab extends circumferentially from a first end to a second end, and the first end is joined to an annular wall by a closing wall. The system also provides for an auxiliary window obtained through the annular wall of the main skirt, and a rigid auxiliary tooth of the neck, suitable to snap into the auxiliary window.

17 Claims, 14 Drawing Sheets

(58) Field of Classification Search
CPC ... B05B 11/3043; B65D 41/02; B65D 41/026; B65D 41/0414; B65D 41/0421; B65D 41/0428; B65D 41/0471; B65D 41/3423; B65D 41/60; B65D 41/04; B65D 41/17; B65D 41/47
USPC ..... 222/372, 381, 383.1, 401; 239/333
See application file for complete search history.

(56) References Cited

U.S. PATENT DOCUMENTS

| | | | | |
|---|---|---|---|---|
| 6,196,423 | B1 * | 3/2001 | Erxleben | B05B 11/0027 222/153.09 |
| 9,611,079 | B2 * | 4/2017 | Mazurkiewicz | B65D 41/0421 |
| 2006/0289679 | A1 * | 12/2006 | Johnson | B05B 9/0861 239/333 |
| 2008/0257913 | A1 * | 10/2008 | Contiero | B05B 11/001 222/383.1 |
| 2020/0261934 | A1 * | 8/2020 | Alluigi | B05B 11/3011 |
| 2020/0316626 | A1 * | 10/2020 | Alluigi | B05B 11/3045 |

FOREIGN PATENT DOCUMENTS

| | | | |
|---|---|---|---|
| EP | 1982770 | A2 | 10/2008 |
| WO | 2012092989 | A1 | 7/2012 |
| WO | 2012153540 | A1 | 11/2012 |

* cited by examiner

CONNECTION SYSTEM BETWEEN A BOTTLE AND A DISPENSING HEAD

CROSS-REFERENCE TO RELATED APPLICATIONS

This application is a National Stage Application of International Patent Application No. PCT/IB2018/053384, having an International Filing Date of May 15, 2018, which claims the benefit of priority to Italian Patent Application No. 102017000085464, filed Jul. 26, 2017, and to Italian Patent Application No. 102017000143091, filed Dec. 12, 2017, the entire contents of which are hereby incorporated by reference herein.

FIELD OF THE INVENTION

The present invention is in the field of trigger dispensing devices; in particular, the object of the present invention is a connection system between a dispensing head and a bottle of the trigger dispensing device.

BACKGROUND OF THE INVENTION

As is known, such dispensing devices are today enormously widespread in various fields: home hygiene, air fresheners, fabric treatment with stain removers or before ironing, gardening, and many others. Every year, millions of dispensing heads and bottles are produced.

In a filling system, the bottles are filled with the desired liquid, for example a detergent, and highly automated machines are used to apply the dispensing head to the respective bottle.

It is therefore essential for the connection system between the dispensing head and the bottle to allow a rapid, effective and reliable application.

For this purpose, bayonet connection systems are particularly effective. An example of embodiment is illustrated in the document EP-A2-0867230 in the name of the Applicant.

Moreover, more and more often, the dispensing devices are reusable so as to be filled by the user with the desired product, purchased in refill packs.

The connection system between the dispensing head and the bottle must therefore be reversible, in the sense that the user must be able to easily separate the head from the bottle, to proceed with filling the bottle and reapplying the head.

However, it has been found that, after some repeated operations of separating the head from the bottle and reapplying it, the currently known connection systems undergo rapid deterioration which manifests itself in a rapid decay of the torque necessary for the user to rotate the head and separate it from the vial and the consequent instability of the connection when the head is reapplied to the bottle.

Some solutions aim to solve such problem. For example, the solution illustrated in the document WO-A1-2012/153540 is known.

SUMMARY OF THE INVENTION

The object of the present invention is to better contribute to the solution of this problem by devising a connection between the dispensing head and the bottle for which the separation torque does not undergo rapid decay and at the same time is not particularly high at the first use of the device.

Such object is achieved by a connection system having the features described and claimed herein.

BRIEF DESCRIPTION OF THE DRAWINGS

The features and advantages of the connection system according to the present invention will be apparent from the description given below, provided by way of non-limiting example, in accordance with the accompanying figures, wherein.

DETAILED DESCRIPTION

Figure 1:
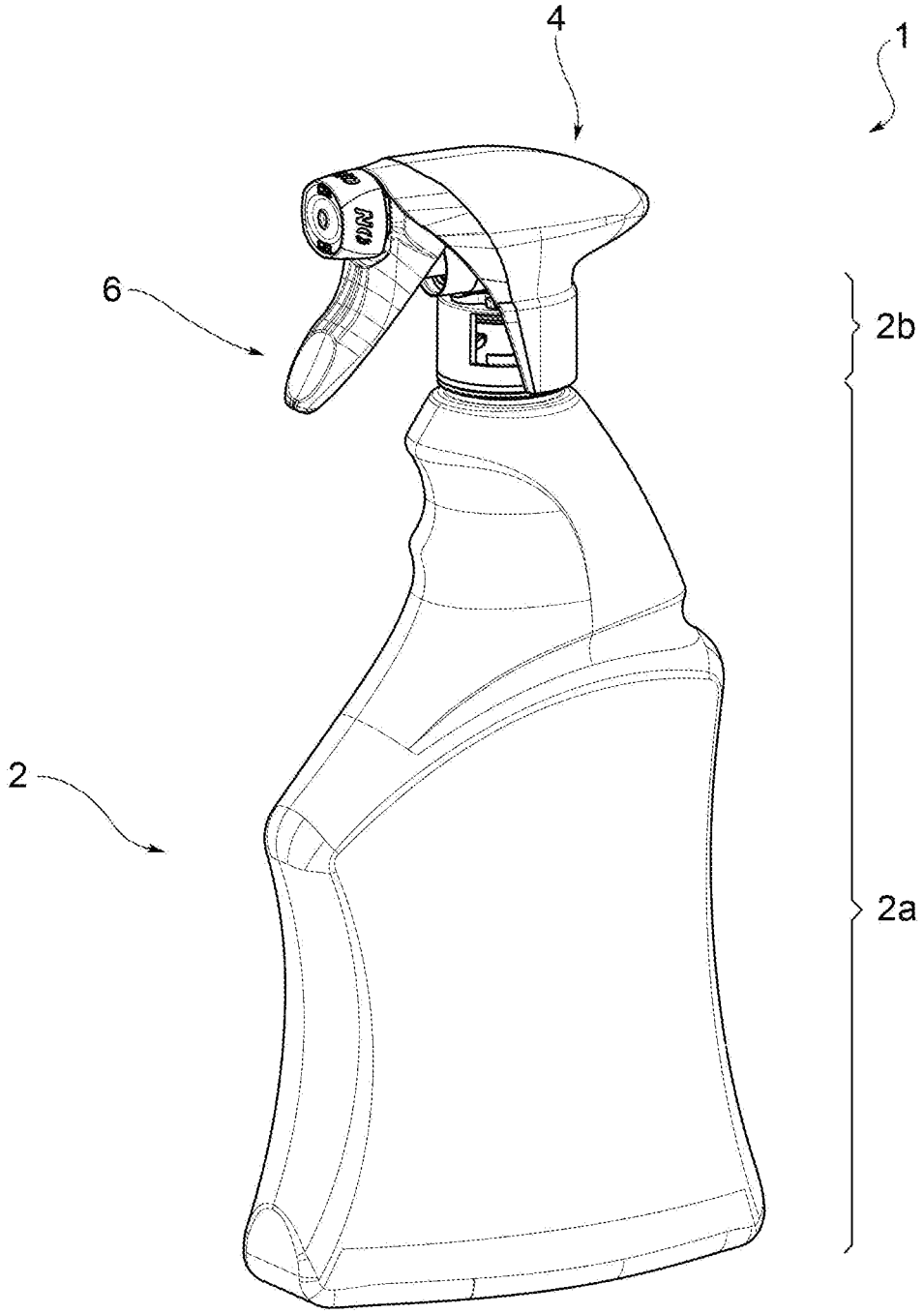
FIG. 1 illustrates a dispensing device comprising a connection system according to the present invention.
Figure 2:
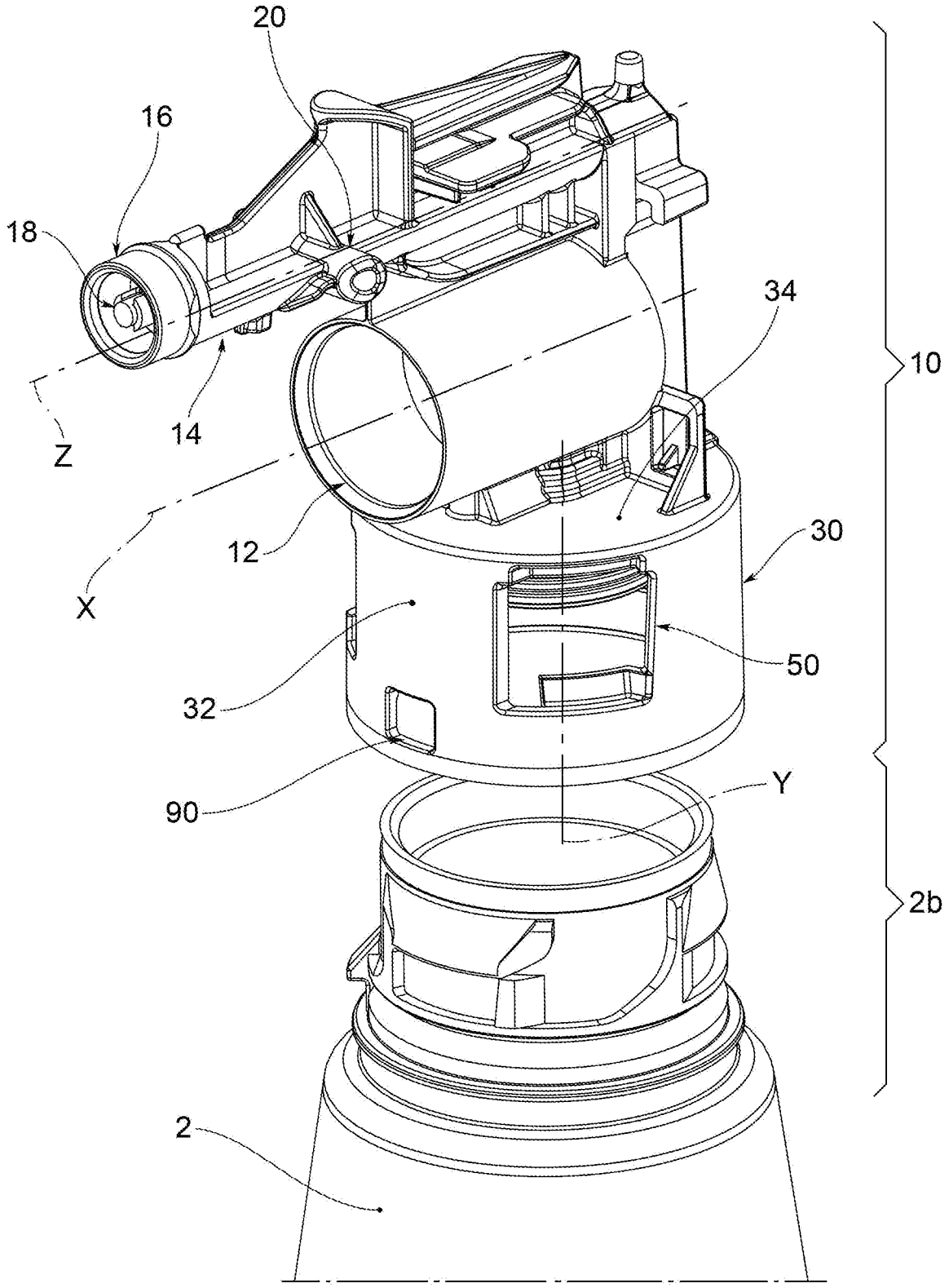
FIG. 2 represents a neck and a chassis of the connection system of FIG. 1.

With reference to the accompanying figures, a dispensing device for liquids, such as detergent liquids, deodorizers and the like, is collectively indicated at 1.

The dispensing device 1 comprises a bottle 2 for containing the liquid to be dispensed and a dispensing head 4, provided with a trigger 6, applied to the bottle 2.

In particular, the bottle 2 comprises a bottle body 2*a* and a bottle neck 2*b*, in a single piece with the bottle body, for connecting with the dispensing head 4.

According to a variant embodiment (not shown), the neck is made as a separate piece, suitably engaged with the bottle body.

The dispensing head 4 comprises a chassis 10 for supporting the functional components for dispensing the product.

For example, the chassis 10 has a piston chamber 12, internally cylindrical, having extension along a chamber axis X, designed to accommodate slidably a piston.

Said chassis 10 further comprises a dispensing duct 14, which extends along a dispensing axis Z, preferably parallel and distinct from the chamber axis X, into which the liquid dispensed from the piston chamber 12 is conveyed, preferably terminating with a dispensing chamber 16 provided with a dispensing port 18 for dispensing the liquid into the external environment.

According to an embodiment, said chassis further comprises a coupling portion 20 for hinging the trigger 6; for example, said coupling portion 20 is arranged along the dispensing duct 14.

According to one embodiment, to the chassis 10 are applied said piston, a dispensing nozzle at the dispensing chamber 16, said trigger 6 on the coupling portion 20, suction, dispensing and venting valve means and a cover, which, preferably, covers at least part of the chassis, on the top and at the sides.

A connection system according to the present invention comprises a main skirt 30 consisting of a typically cylindrical annular wall 32 having a central skirt axis Y; the main skirt 30 is intended to be connected to the neck 2*b* of the bottle 2.

According to a preferred embodiment, the main skirt 30 is made in one piece with the whole chassis 10.

According to a variant embodiment (not shown), the main skirt is made separately and appropriately connected to the remaining part of the chassis.

Said main skirt 30 further comprises a bottom which closes the annular wall 32. The base 34 is orthogonal to the skirt axis Y and above it are found the piston chamber 12 and the dispensing duct 14.

The main skirt 30 comprises a plurality of flexible tabs 40, 42, 44, arranged in the space delimited by the annular wall 32, projecting cantilevered therefrom.

Figure 3:
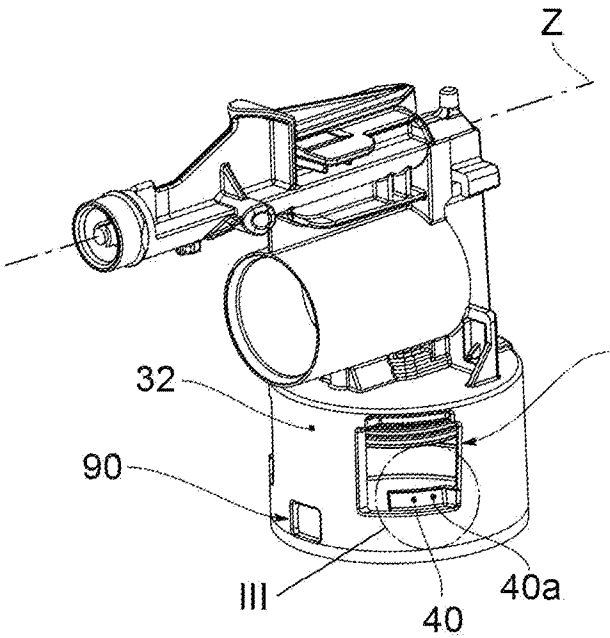
FIGS. 3 to 8 show the chassis of the connection system according to the present invention, according to different observation points and relative enlargements.
Figure 4:
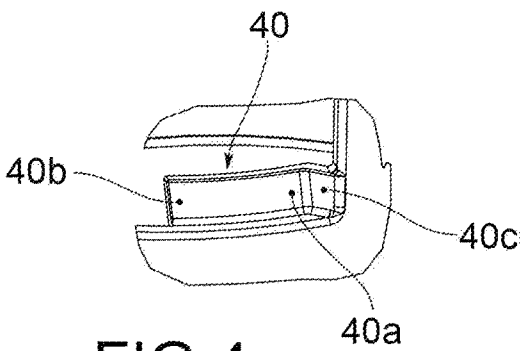

According to a preferred embodiment, the main skirt 30 comprises a first tab 40 (FIGS. 3 and 4), projecting internally from the annular wall 32, so as to be cantilevered; preferably, the first tab 40 is inclined inwards.

The first tab 40 extends angularly from a first end 40*a* to a second end 40*b*.

The first end 40*a* is joined to the annular wall 42 by a closing wall 40*c*, whereas, preferably, the second end 40*b* is free.

Preferably, a median plane of the closing wall 40*c* lies on an imaginary plane parallel to the skirt axis Y or on an imaginary plane containing the skirt axis Y.

Preferably, at the first tab 40, the main skirt 30 has a first window 50 through the annular wall 32, and the first tab 40 is placed inside the first window 50.

Preferably, the first tab 40 has a lower angular extension of the circumferential opening of the first window 50.

Preferably, moreover, the closing wall 40*c* joins the first end 40*a* of the first tab 40 with the respective lateral edge of the first window 50.

Figure 5:
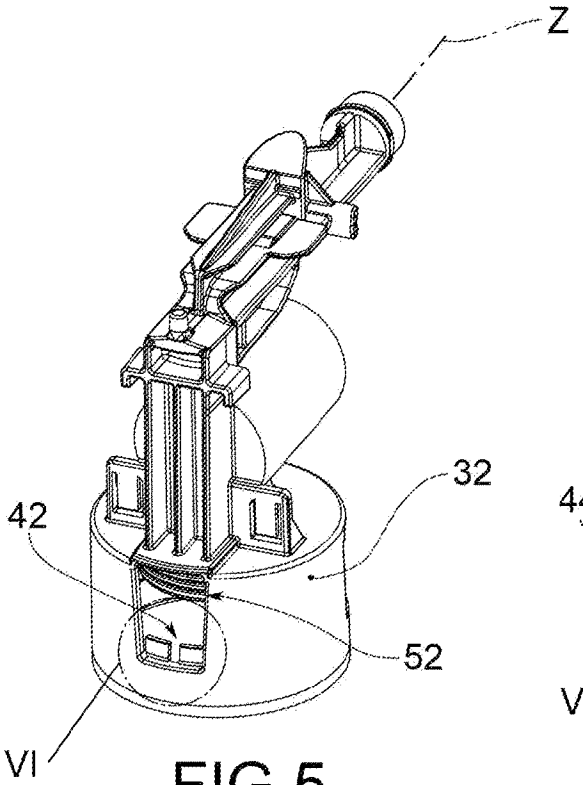
Figure 6:
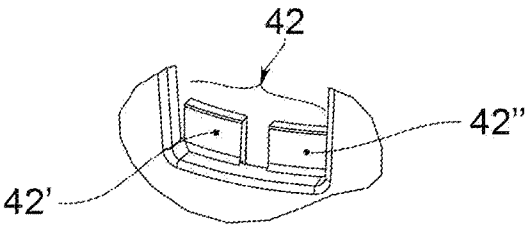

According to a preferred embodiment, the main skirt 30 further comprises a second tab 42, positioned angularly spaced from the first tab 40 (FIGS. 5 and 6).

Also said second tab 42 projects internally from the annular wall 32, so as to be cantilevered; preferably, the second tab 42 is inclined inward.

Preferably, the second tab 42 is made in two parts 42', 42", separated circumferentially; preferably, each part 42', 42" has free ends.

Preferably, at the second tab 42, the main skirt 30 has a second window 52 through the annular wall and said second tab 42 is placed inside the second window 52.

Figure 7:
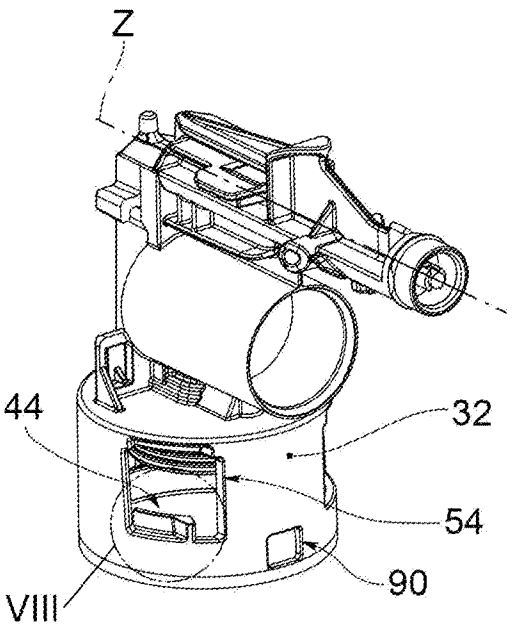
Figure 8:
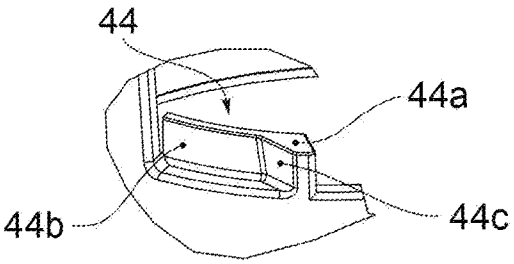

According to yet another preferred embodiment, the main skirt 30 further comprises a third tab 44, positioned angularly spaced from the first tab 40 and from the second tab 42 (FIGS. 7 and 8).

Also said third tab 44 projects internally from the annular wall 32, so as to be cantilevered; preferably, the third tab 44 is inclined inward.

The third tab 44 extends angularly from a first end 44*a* to a second end 44*b*.

The first end 44*a* is joined to the annular wall by a reinforcing wall 44*c*, while, preferably, the second end 44*b* is free.

Preferably, the reinforcing wall 44*c* has a decreasing thickness towards the annular wall 32.

Preferably, at the third tab 44, the main skirt 30 has a third window 54 through the annular wall 32 and said third tab 44 is located inside the third window 54.

Preferably, the reinforcing wall 44*c* meets the lower edge of the window 54 in an intermediate position between the ends.

Figure 9:
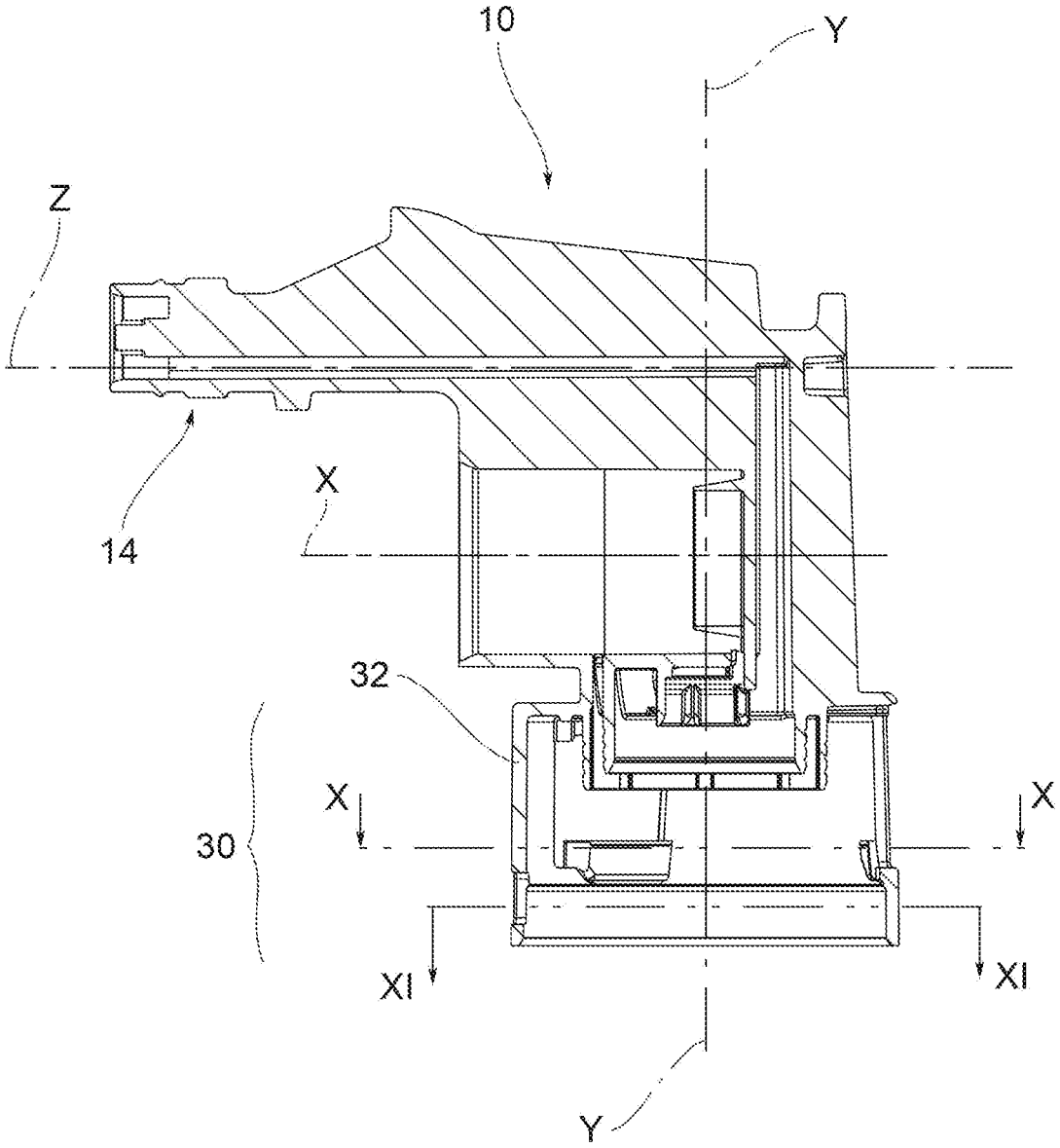
FIG. 9 illustrates a longitudinal sectional view of the chassis of FIG. 3.
Figure 10:
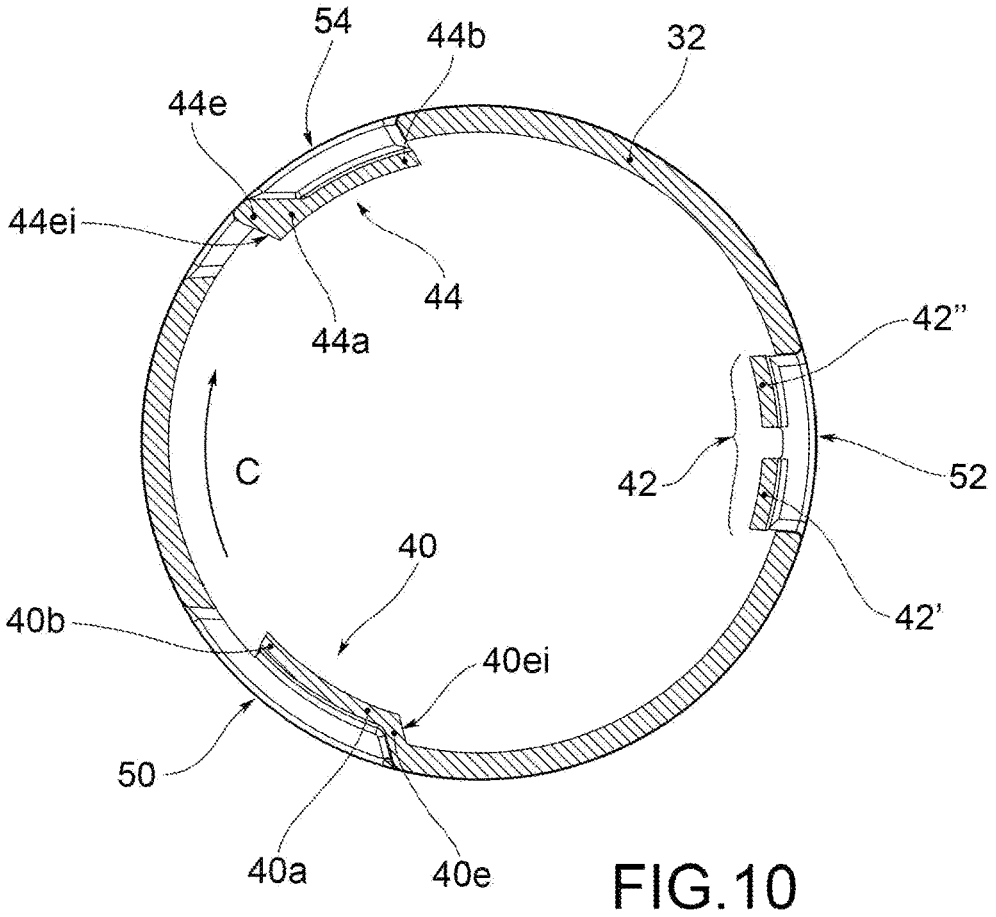
FIG. 10 is a cross-sectional view of the chassis of FIG. 9, according to the cross-sectional plane X-X in FIG. 9.
Figure 11:
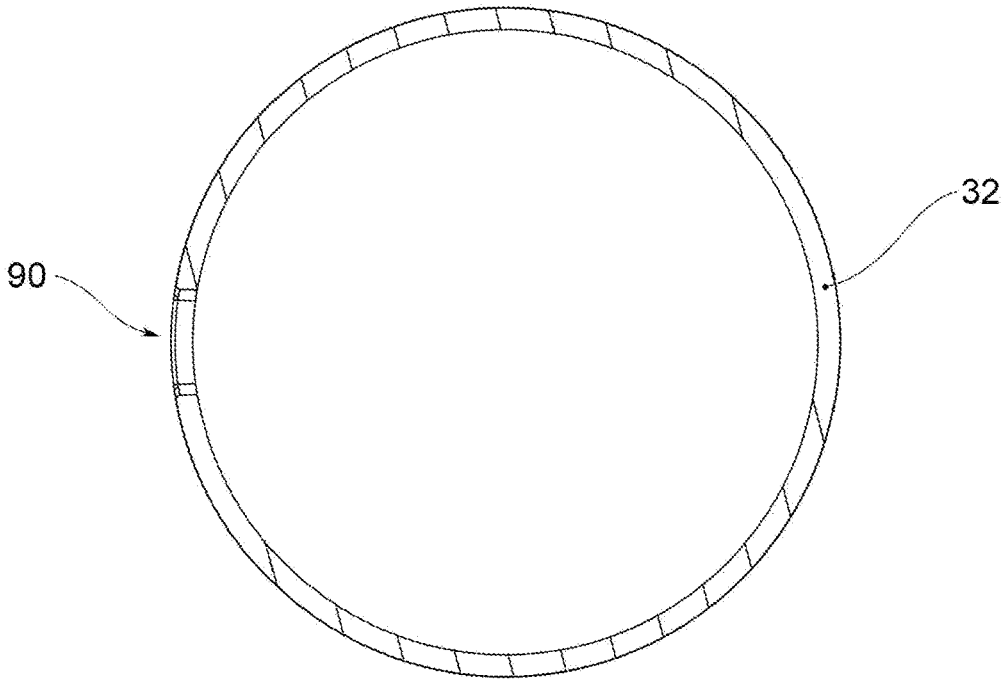
FIG. 11 is a cross-sectional view of the chassis of FIG. 9, according to the cross-sectional plane XI-XI in FIG. 9.

By observing the main skirt 30 in cross-section (FIGS. 9, 10 and 11) along the skirt axis X from above, i.e., from the part of the dispensing duct 14, it is possible to define a clockwise direction C, with respect to which the first tab 40 precedes the second tab 42 and between these is placed the third tab 44.

With reference to the first tab 40, in the clockwise direction C identified above, the first end 40*a* is arranged at the start of the first tab 40, i.e. before the second free end 40*b*; therefore, the closing wall 40*c* precedes said second end 40*b*.

Moreover, preferably, the inner surface 40*ci* of the closing wall 40*c* is connected to the inner side surface 32*i* of the annular wall 32, forming an obtuse angle therewith, so that, according to the clockwise direction C, a ramp is formed towards the inside of the main skirt 30.

Preferably, likewise, with reference to the third tab 44, in the clockwise direction C identified above, the first end 44*a* is arranged at the beginning of the third tab 44, i.e. before the second free end 44*b*; therefore, the reinforcing wall 44*c* precedes said second end 44*b*.

Moreover, preferably, the inner surface 44*ci* of the closing wall 44*c* forms an obtuse angle with the inner side surface 32*i* of the annular wall 32 so that, according to the clockwise direction C, a ramp is formed towards the inside of the main skirt 30.

The main skirt 30 is intended to snap-fit with the neck 2*b* of the bottle 2.

Said neck 2*b*, preferably, provides for an annular edge 60, having a predefined axial height which circumferentially delimits the mouth of the bottle 2.

Axially below the annular edge 60, on the outer surface thereof, the neck 2*b* provides for circumferential coupling regions 70, 72, 74 for the tabs 40, 42, 44 of the main skirt.

Figure 12:
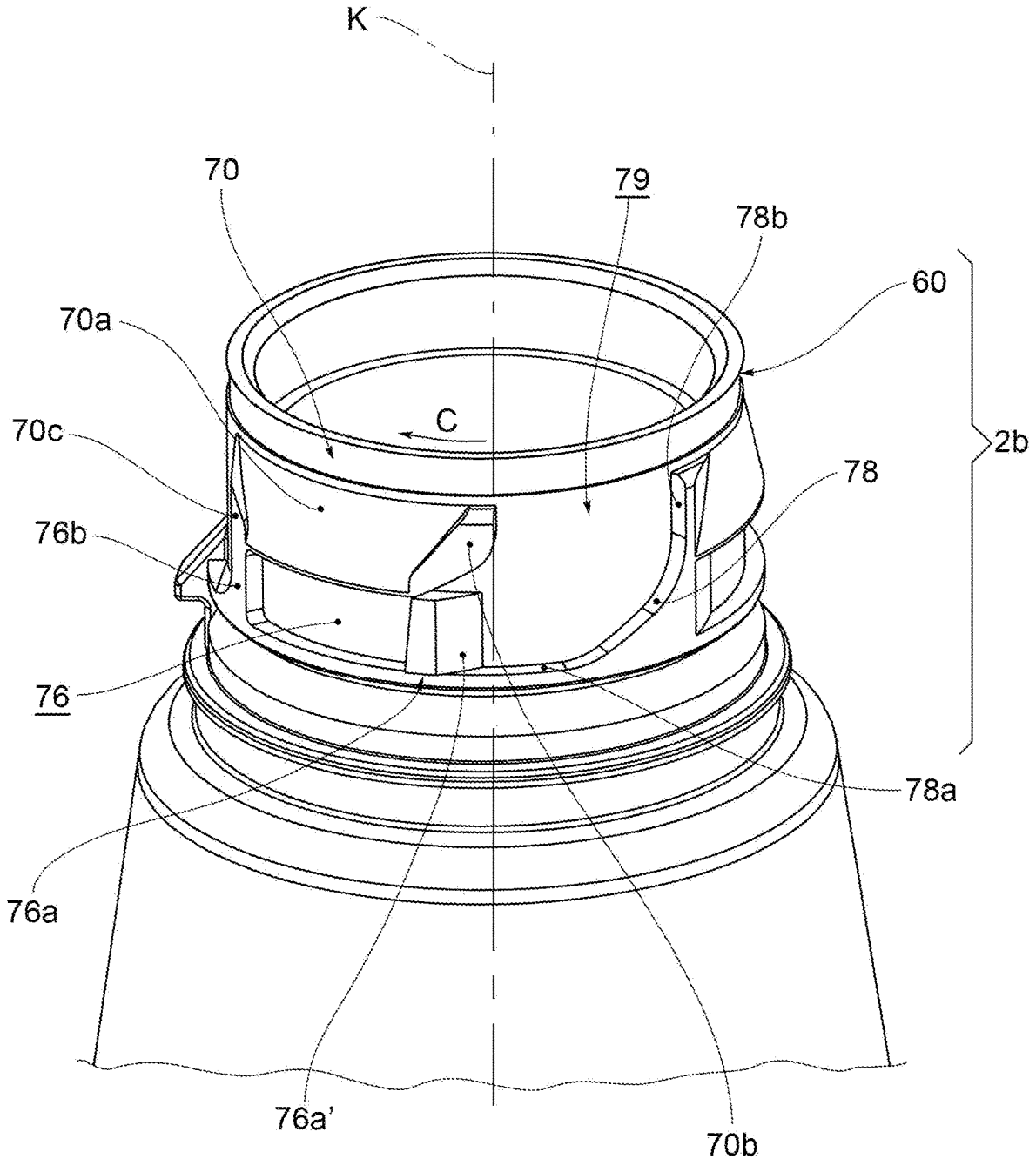
FIG. 12 shows a neck of the connection system, according to a first observation point from which a first coupling region is evident.

In particular, the neck 2*b* provides for a first coupling region 70 for the coupling of the first tab 40 (FIG. 12).

Preferably, the first coupling region 70 comprises a first sloping plane 70*a*, having a predefined angular extension, externally projecting from the outer surface of the neck; circumferentially, said first sloping plane 70*a* is delimited by a pair of guide elements 70*b*, 70*c*, which give it a downwardly converging funnel shape.

Preferably, moreover, a first pocket 76, having a predetermined angular extension, at least equal to that of the outlet section of the first sloping plane 70*a*, is arranged below the first sloping plane 70*a*, axially aligned therewith.

The first pocket 76 is circumferentially delimited by a projecting element 76*a* and a stop wall 76*b*.

Preferably, the projecting element 76*a* is provided with a projecting ramp 76*a*', external to the first pocket 76, for facilitating snap-fitting by rotation into said first pocket 76.

The first sloping surface 70*a* has a circumferential extension at least equal to that of the first tab 40 to facilitate snap-fitting by axial translation into said first pocket 76.

The first pocket 76 has a circumferential extension so as to accommodate the first tab 40 and preferably greater than that of the first tab 40.

Furthermore, the first coupling region 70 comprises a first outlet ramp 78, circumferentially flanked by the first sloping plane 70*a* and the first pocket 76.

Between the first outlet ramp 78 on one side and the first sloping plane 70*a* and the first pocket 76 on the other, a first channel 79 is formed.

Said first outlet ramp 78 has an inlet portion 78*a* substantially at the level of the lower edge of the first pocket 76, almost horizontal, and an outlet portion 78*b* substantially terminating at the height of the upper edge of the first, almost vertical sloping plane 70*a*.

Collectively, said first outlet ramp 78 has a sloping progression which suddenly increases from the inlet portion 78*a* to the outlet portion 78*b*, for example with an exponential or hyperbolic progression.

Figure 13:
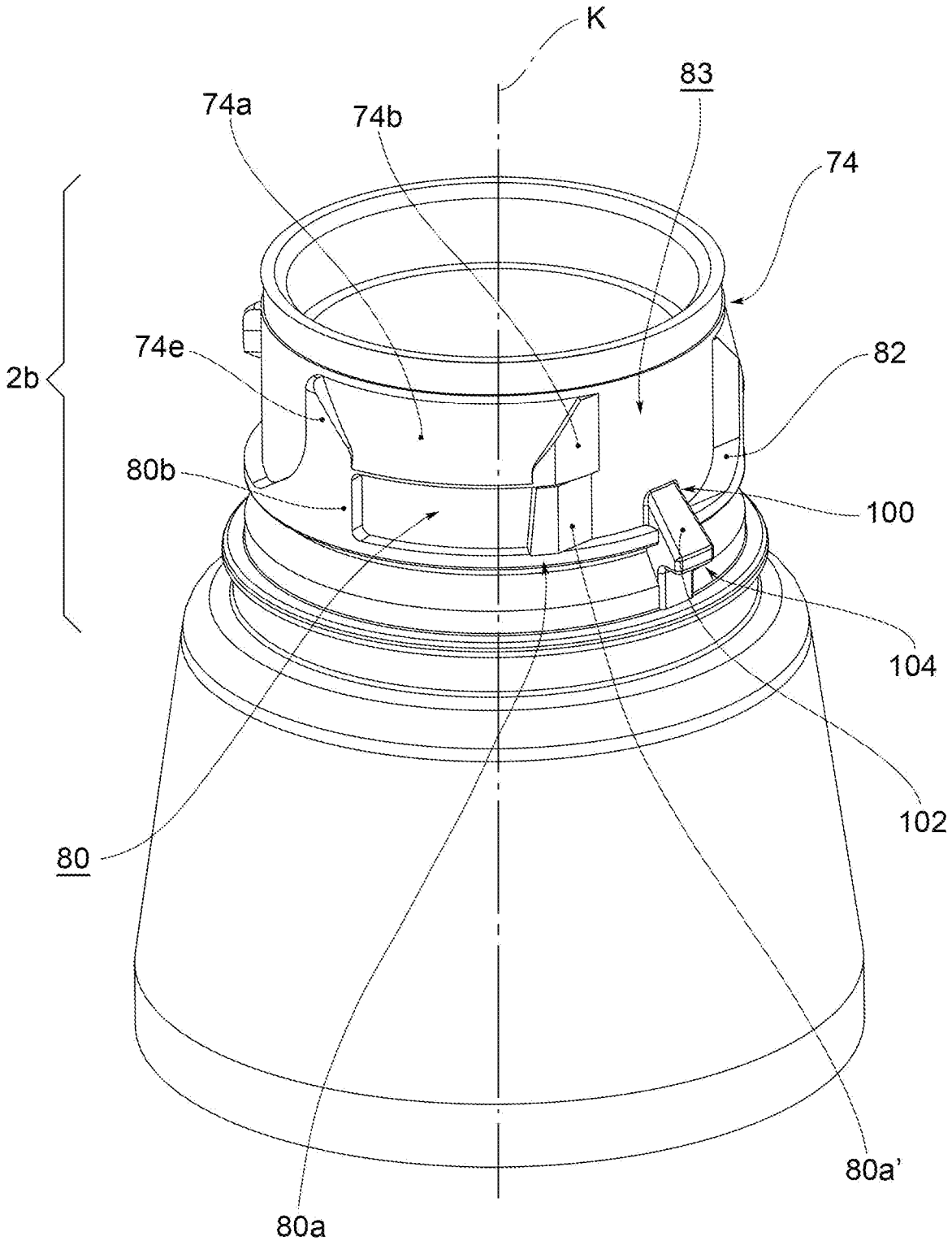
FIG. 13 illustrates the neck of FIG. 12, according to a further observation point from which a second coupling region is evident.
Figure 14:
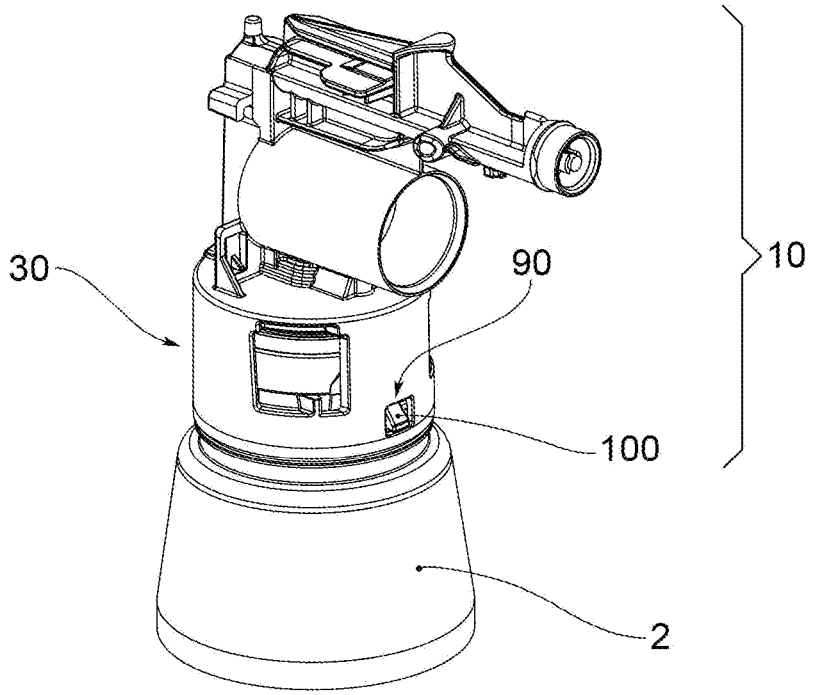
FIGS. 14 to 19 show the connection system in a coupling configuration, and relative cross sections and enlargements.
Figure 15:
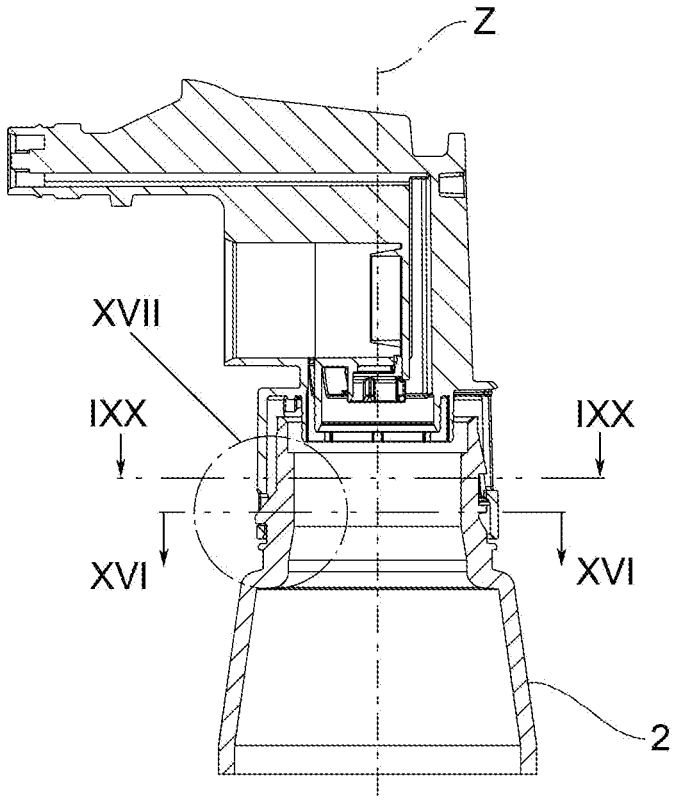
Figure 16:
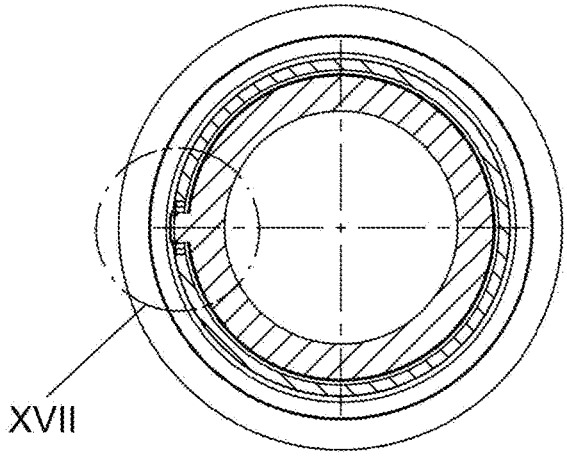
Figure 17:
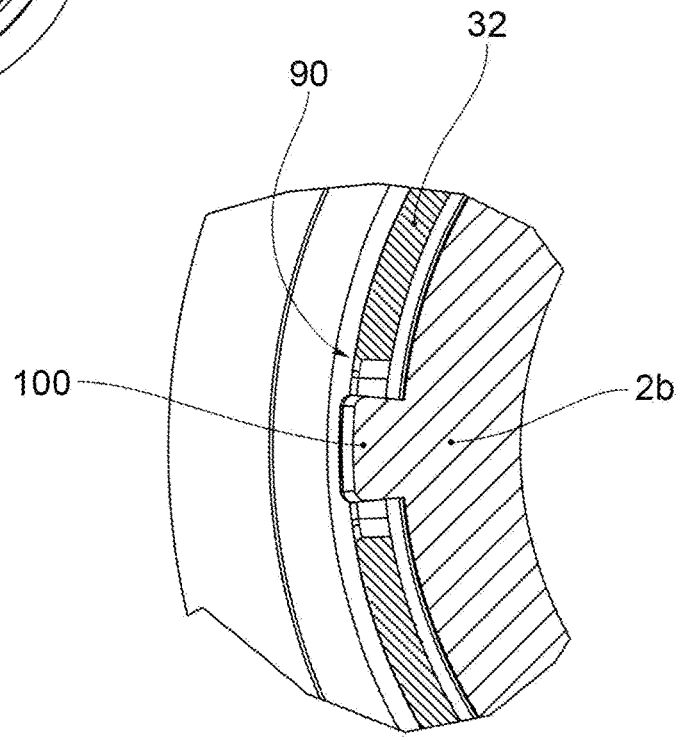
Figure 18:
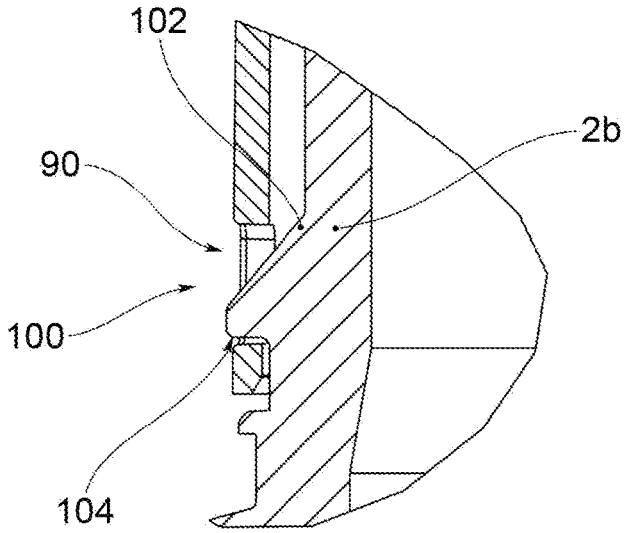
Figure 19:
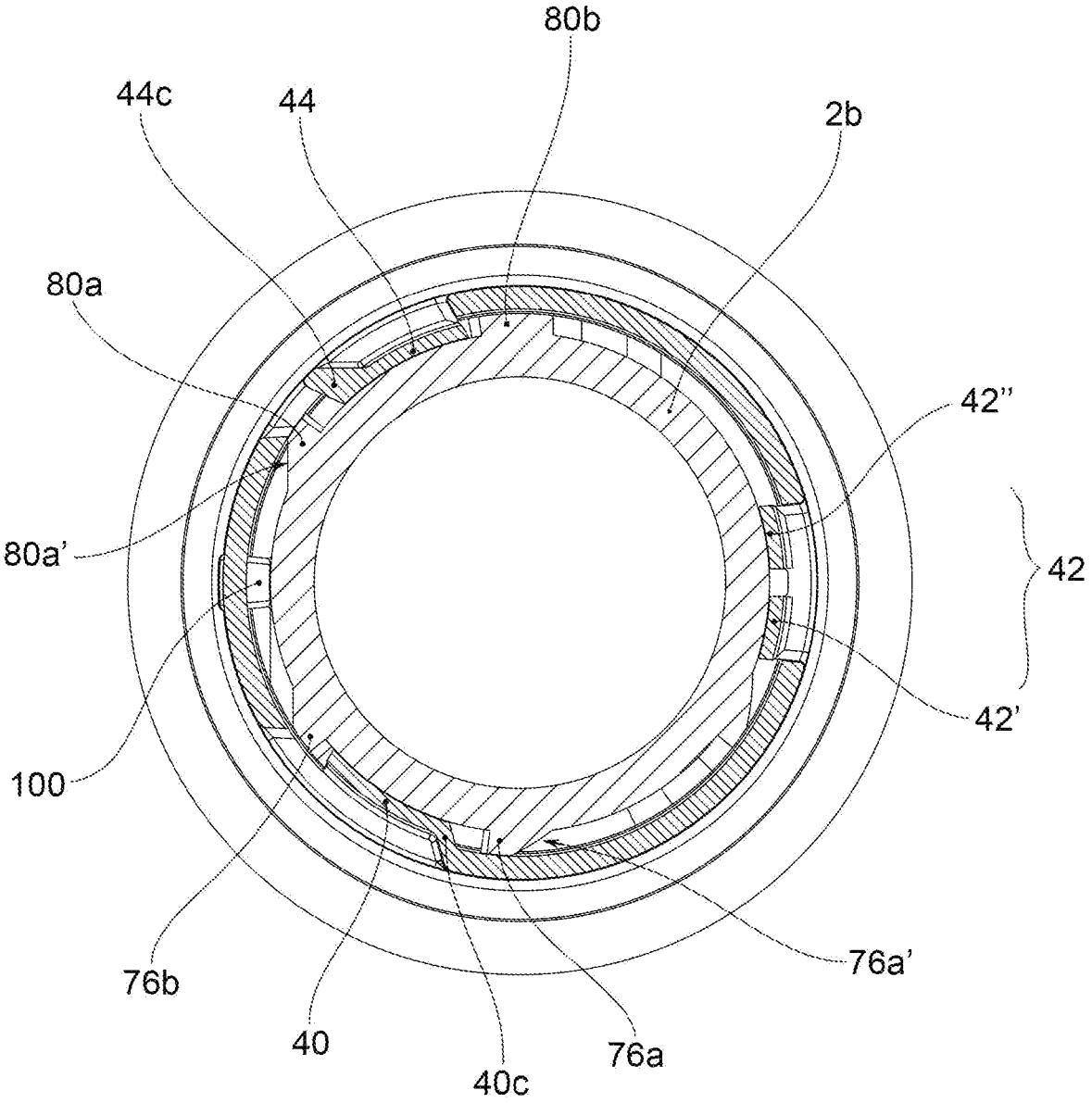

Moreover, the neck 2*b* provides a third coupling region 74 for coupling the third tab 44 (FIG. 13).

Preferably, the third coupling region 74 comprises a first sloping plane 74*a* having a predefined angular extension externally projecting from the outer surface of the neck; circumferentially, said third sloping plane 74*a* is delimited by a pair of guide elements 74*b*, 74*c*, which give it a downwardly converging funnel shape.

Preferably, moreover, a third pocket 80, having a predetermined angular extension, at least equal to that of the outlet section of the second sloping plane 74*a*, is arranged below the third sloping plane 74*a*, aligned axially therewith.

The third pocket 80 is circumferentially delimited by a projecting element 80*a* and a stop wall 80*b*.

Preferably, the projecting element 80*a* is provided with a projecting ramp 80*a*', external to the third pocket 80, for facilitating snap-fitting by rotation into said third pocket 80.

The third sloping surface 74*a* has a circumferential extension at least equal to that of the third tab 44 to facilitate snap-fitting by axial translation into said third pocket 80.

The third pocket 80 has a circumferential extension so as to accommodate the third tab 44 and preferably greater than that of the third tab 44.

Furthermore, the third coupling region 74 comprises a third outlet ramp 82, circumferentially flanked by the third sloping plane 74*a* and the third pocket 80.

Between the third outlet ramp 82 on one side and the third sloping plane 74*a* and the third pocket 80 on the other, a third channel 83 is formed.

Said third outlet ramp 82 has a structure and functionality similar to that of the first outlet ramp 78.

Finally, the neck 2*b* has a second coupling region 72 for the coupling of the second tab 42, for example comprising a second sloping plane and a second pocket.

According to a preferred embodiment, the connection system further comprises an auxiliary window 90 and a substantially rigid auxiliary tooth 100.

The auxiliary window 90 is obtained through the annular wall 32 of the main skirt 30.

Preferably, said auxiliary window 90 is arranged circumferentially so that, in the clockwise direction C, proceeding from the first tab 40 towards the third tab 44, one encounters first said auxiliary window 90 and then said third tab 44.

In other words, preferably, said auxiliary window 90 is arranged circumferentially so that, in the clockwise direction C, proceeding from the first window 50 to the third window 54, one encounters first said auxiliary window 90 and then said third window 54.

Preferably, moreover, the auxiliary window 90 is arranged axially below the lower edge of the first window 50 and the third window 54.

The auxiliary tooth 100 protrudes from the outer surface of the neck 2*b* and is preferably provided, at the top, with a tooth plane 102 inclined downwardly, like the sliding planes 70*a*, 74*a*, which forms an undercut 104.

Preferably, moreover, the sides circumferentially delimiting the tooth diverge towards the outside, so as to hinder, at least in part, the emerging of the tooth from the window by the relative rotation of the skirt with respect to the neck.

Preferably, the auxiliary tooth 100 is arranged in the third coupling region 74, and preferably in such a way that, in the clockwise direction C, proceeding from the third outlet ramp 82 to the third pocket 80, one encounters first said auxiliary tooth 100 and then said third pocket 80.

Preferably, moreover, the auxiliary tooth 100 is arranged axially at the lower edge of the third pocket 80.

The auxiliary window 90 is suitable to snap-fit with the auxiliary tooth 100 to create a further rotational and axial constraint point between the main skirt 30 and the neck 2*b*.

Figure 24:
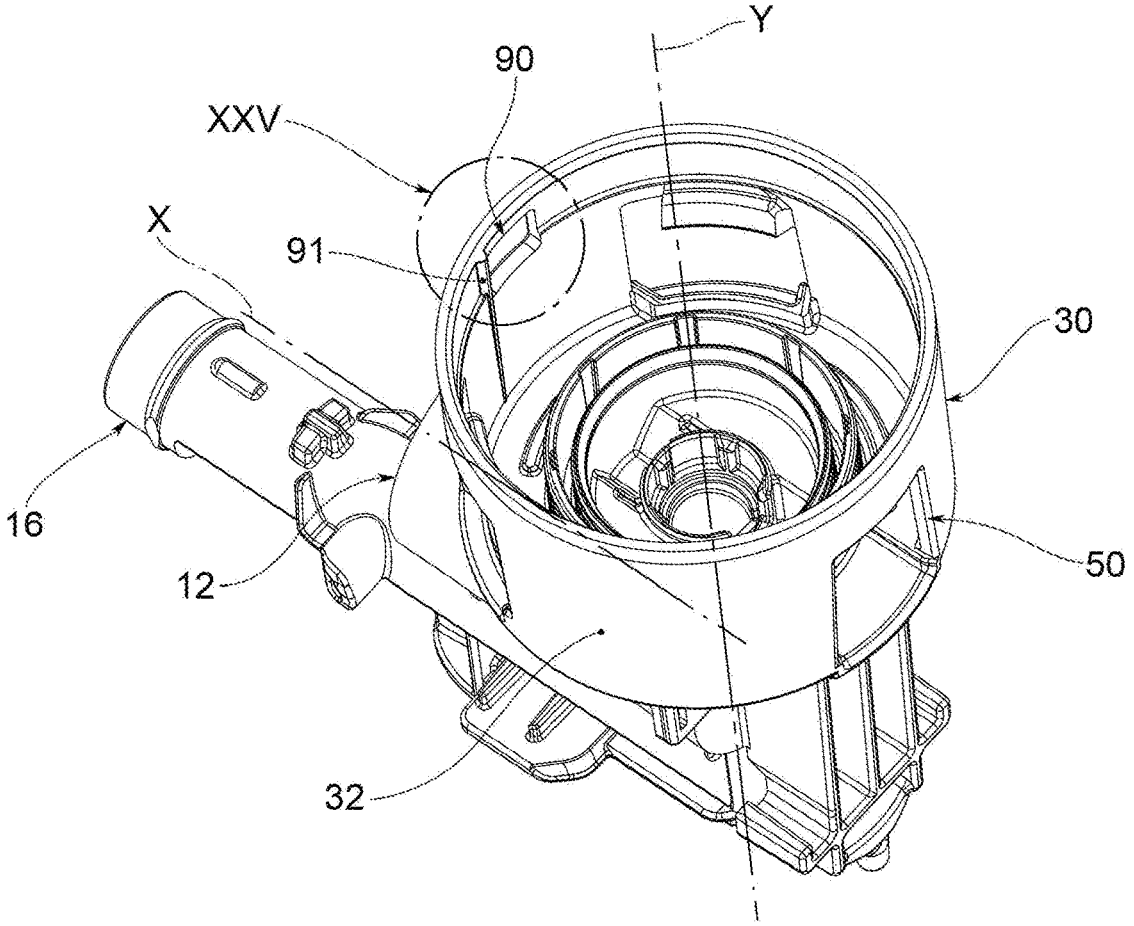
FIG. 24 illustrates a chassis of a dispensing device according to the present invention, according to a further embodiment.
Figure 25:
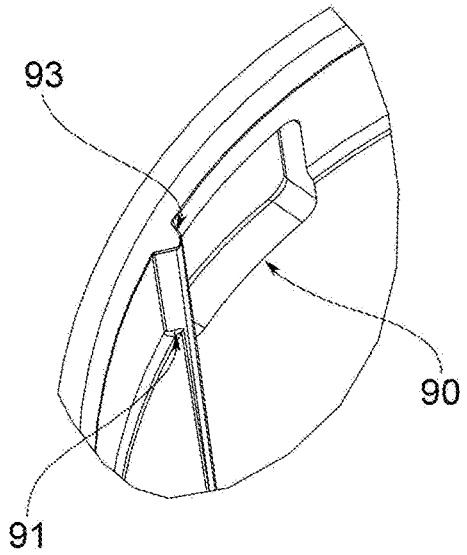
FIG. 25 is an enlargement of the area XXV in FIG. 24.

According to one embodiment of the chassis 10 (FIGS. 24 and 25), the connection system further comprises an auxiliary rib 91 projecting from the inner surface of the annular wall 32 of the main skirt 30, flanked by the auxiliary window 90, so as to constitute a stop for the auxiliary tooth 100 when it emerges from the auxiliary window 90.

Preferably, the auxiliary rib 91 has a substantially axial progression and is delimited, at least on the side facing the auxiliary window 90, by an inclined side 93, to facilitate the emerging of the auxiliary tooth 100.

Advantageously, said auxiliary rib 91 makes the intensity of the torque necessary for the first opening of the device less variable.

According to one coupling method, particularly suitable for the automatic coupling performed by filling machines, starting with the dispensing head 4 separated from the bottle 2, placing the dispensing head 4 and the bottle 2 in a predefined mutual angular position of alignment, the dispensing head 4 is axially insertable on the neck 2*b*, so that the dispensing device 1 is brought into the coupling configuration (FIGS. 14 to 19 and FIG. 23*a*).

The dispensing head 4 and the bottle 2 are arranged in the relative position of alignment when the first tab 40 is axially aligned with the first sloping plane 70*a* (consequently, the third tab 44 is aligned with the third pocket 80); this mutual arrangement generally corresponds to positioning the dispensing nozzle at the front of the device.

To reach the coupling configuration, during axial translation, the first tab 40 slides over the first sloping plane 70*a* and snaps into the first pocket 76, and, at the same time, the third tab 44 slides over the third sloping plane 74*a* and snaps into the third pocket 80.

Simultaneously, the second tab 42 slides to snap-fit and couple with the second coupling region 72.

At the same time, preferably, the auxiliary tooth 100, by causing a local deformation of the annular wall 32, snaps into the auxiliary window 90, facilitated by the tooth plane 102.

To disengage the dispensing head 4 from the bottle 2, it is necessary first of all to complete a relative rotation of the head 4 with respect to the neck 2*b*, until an intermediate configuration, and then a relative axial disengagement of the head 4 from the neck 2*b*, is reached.

The relative rotation of the chassis 10 with respect to the neck 2*b*, causes the auxiliary tooth 100, locally deforming the annular wall area around the auxiliary window, to be forced out of said auxiliary window 90, in contrast with the annular wall 32, which undergoes localized deformation.

Figure 20:
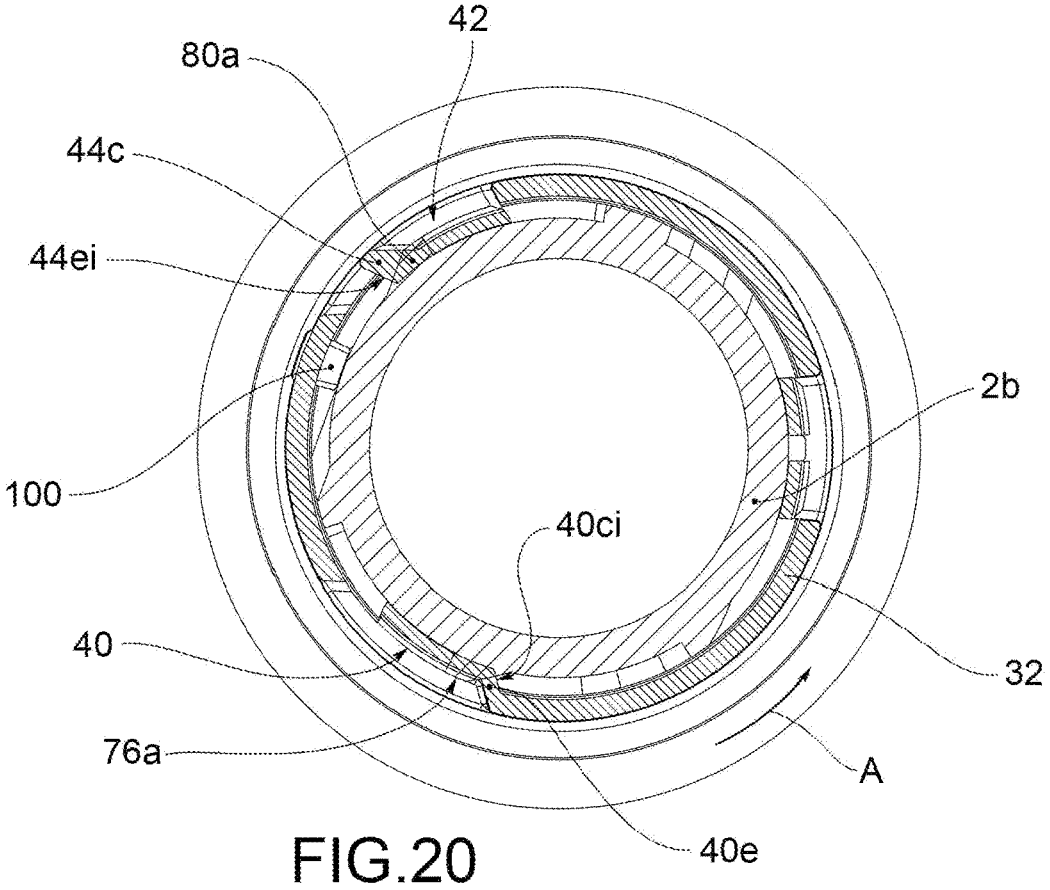
FIGS. 20 to 22 show cross-sectional views of the connection system, in successive configurations, from the coupled configuration to an uncoupled configuration.
Figure 23D:
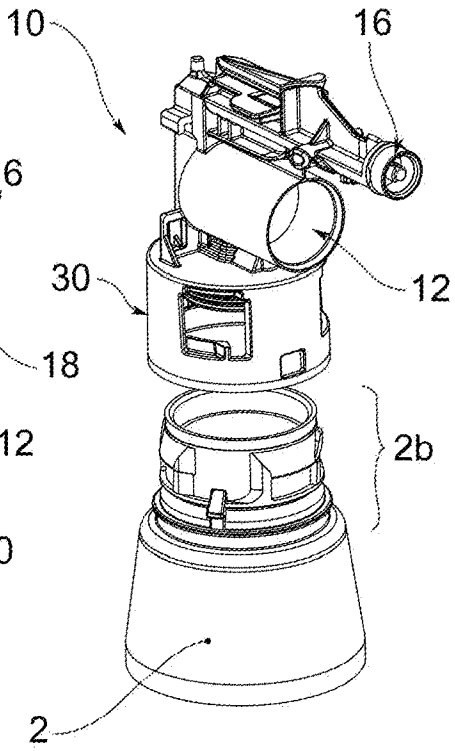
FIGS. 23*a* to 23*d* show the connection system, in successive configurations, from the coupled configuration to the uncoupled configuration.
Figure 23C:
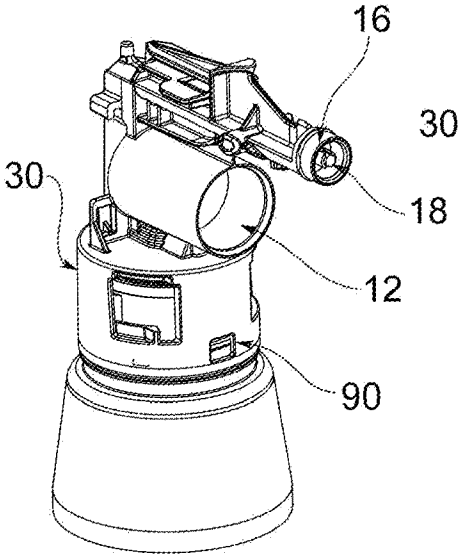
Figure 23B:
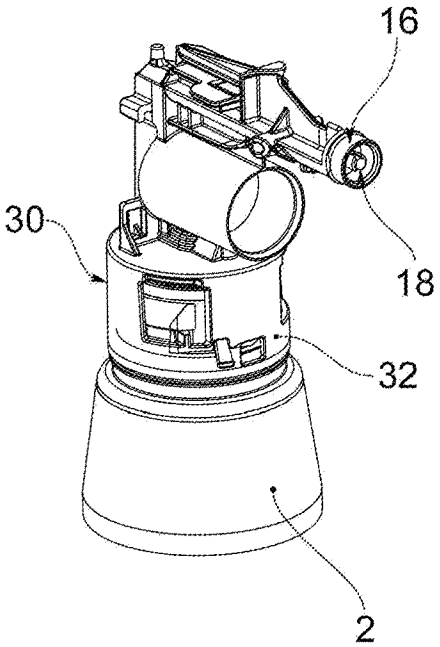
Figure 23A:
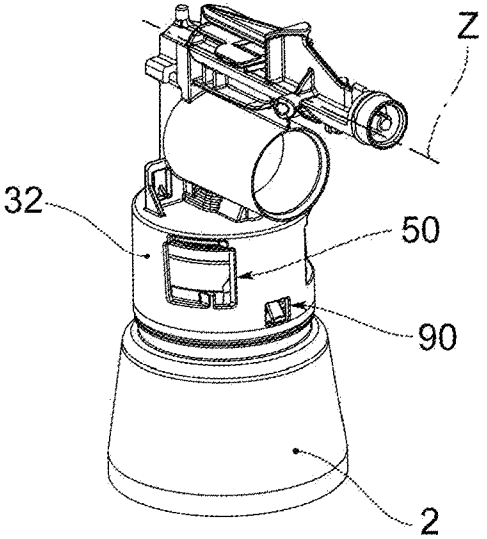

For example, by rotation according to a counterclockwise direction A of the head 4 with respect to the neck 2*b* (FIGS. 20 and 23*b*), the first tab 40 is pushed radially outwardly by the projecting element 76*a* of the first coupling region 70.

In particular, said projecting element 76*a* acts on the inner surface 40*ci* of the closing wall 40*c* of the first tab 40, causing a deformation thereof.

In the same way, the third tab 44 is pushed radially outwardly by the projecting element 80*a* of the third coupling region 74.

In particular, said projecting element 80*a* acts on the inner surface 44*ci* of the reinforcing wall 44*c* of the third tab 44, causing a deformation thereof.

Figure 21:
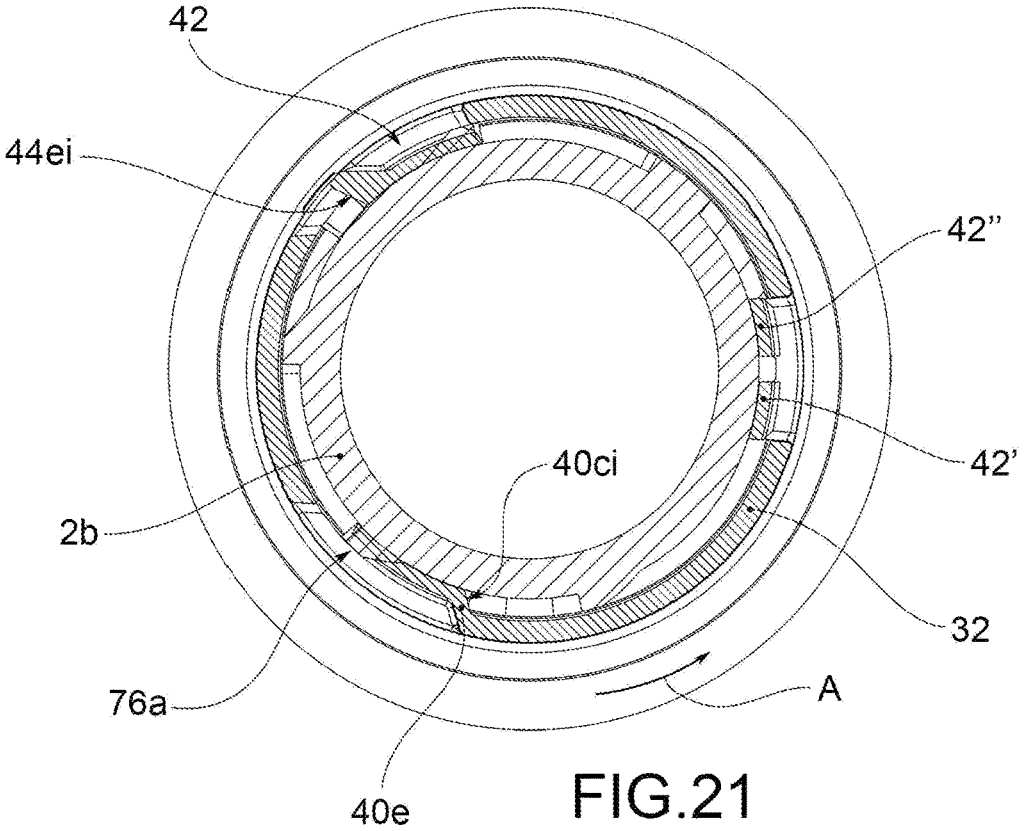

Continuing the rotation in the counterclockwise direction A (FIGS. 21 and 23*c*), the first tab 40 surpasses the projecting element 76*a* and is placed in the first channel 79, while the third tab 44 surpasses the projecting element 80*a* and is placed in the third channel 83. During rotation, the auxiliary tooth 100 continues to locally deform the annular wall 32.

Figure 22:
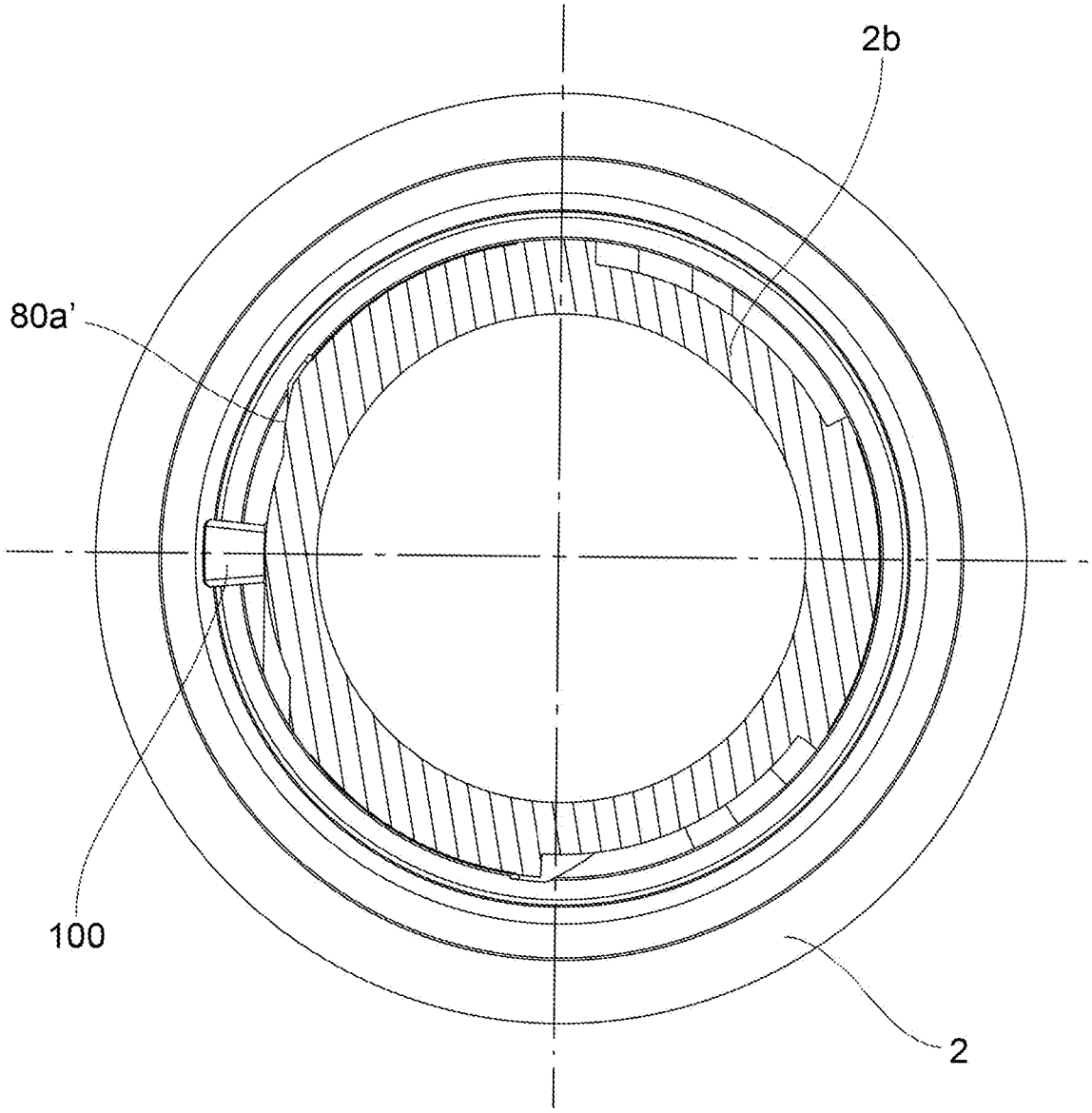

Continuing the rotation in the counterclockwise direction A (FIGS. 22 and 23*d*), the first tab 40 moves along the first ramp 78 and the third tab 44 moves along the third ramp 82, thus guiding said tabs in an axial translation which axially disengages the dispensing head 4 and the bottle 2.

At the same time, the auxiliary tooth 100, overcoming the resistance to deformation of the annular wall 32, protrudes axially from the main skirt 30.

Innovatively, the connection system according to the present invention solves the problem mentioned above, insofar as it ensures a good torque resistant to the mutual rotation both at the first opening and in the successive openings.

The Applicant, by performing some experimental tests, has, for example, shown how the first opening torque varies between 230 Nm and 300 Nm, while the torque for the fifth opening varies between 100 Nm and 150 Nm.

The decay of the opening torque for devices of the prior art is decidedly more sudden, and generally passes from 300 Nm for the first opening torque to 70 Nm for the fifth opening torque.

It is maintained that such effect is achieved by virtue of the particular structure of the first and third tabs, provided, respectively, with a closing wall and a reinforcing wall, which help make the system more rigid.

It is also maintained that such effect is achieved by the presence of the auxiliary tooth, especially as regards maintaining opening torque values after repeated openings.

Finally, it is maintained that the system solves the technical problem also by virtue of the synergistic combination of the effects of the tabs and the auxiliary tooth, since, for example, the deformation of the tabs causes a deformation of the annular wall in the vicinity of the auxiliary window, so that the emerging of the auxiliary tooth from said auxiliary window is facilitated.

Advantageously, moreover, the auxiliary tooth participates in maintaining the opening torque, as once it leaves the auxiliary window, it works in contraction with the resistance to deformation of the annular wall, which remains substantially unchanged after numerous openings.

It is clear that one skilled in the art may make modifications to the connection system described above, all contained within the scope of protection as defined by the following claims.

What is claimed is:

1. A dispensing head for coupling with a bottle provided with a trigger and comprising a chassis for supporting functional components for dispensing the product, wherein the chassis comprises a main skirt made in one piece with the whole chassis and is suitable to snap-fit with a neck of the bottle, wherein the main skirt comprises a cylindrical annular wall having a central skirt axis and is suitable to be connected to the neck of the bottle, wherein the main skirt comprises a plurality of flexible tabs, arranged in the space delimited by the annular wall, projecting cantilevered therefrom, wherein the plurality of flexible tabs comprises a first tab, projecting internally from the annular wall to a top edge, so as to be cantilevered and inclined inwardly towards the central skirt axis, the first tab being suitable to be coupled with a first coupling region of the neck, wherein the first tab extends angularly about the central skirt axis from a first end to a second end, and wherein the first end of the first tab is joined to the annular wall by a closing wall that projects inwardly towards the central skirt axis from the annular wall.

2. A dispensing head according to claim 1, wherein the second end of the first tab is free.

3. A dispensing head according to claim 1, wherein a median plane of the closing wall lies on an imaginary plane parallel to a skirt axis of the main skirt or on an imaginary plane containing the skirt axis.

4. A trigger dispensing device comprising:

a bottle with a bottle neck; and a dispensing head according to claim 1, applied to the bottle neck.

5. A dispensing head according to claim 1, wherein at the first tab, the main skirt has a first window through the annular wall, and the first tab is placed inside the first window.

6. A dispensing head according to claim 5, wherein the first tab has an angular extension lower than that of a circumferential opening of the first window.

7. A dispensing head according to claim 5, wherein the closing wall joins the first end of the first tab with a respective lateral edge of the first window.

8. A dispensing head according to claim 1, wherein the chassis further comprises an auxiliary window through the annular wall of the main skirt.

9. A dispensing head according to claim 8, wherein the chassis further comprises an auxiliary rib projecting from an inner surface of the annular wall of the main skirt, flanked by the auxiliary window.

10. A dispensing head according to claim 9, wherein the auxiliary rib has an axial extension and is delimited, at least on the side facing the auxiliary window, by an inclined side.

11. A dispensing head according to claim 1, wherein the main skirt further comprises a second tab, positioned angularly spaced from the first tab, the second tab projecting internally from the annular wall, so as to be cantilevered and inclined inwardly.

12. A dispensing head according to claim 11, wherein the second tab is made in two parts, separated circumferentially, each part having free ends.

13. A dispensing head according to claim 11, wherein at the second tab, the main skirt has a second window through the annular wall and the second tab is placed inside the second window.

14. A dispensing head according to claim 11, wherein the main skirt further comprises a third tab, positioned angularly spaced from the first tab and from the second tab, the third tab projecting internally from the annular wall, so as to be cantilevered and inclined inwardly, and extending angularly from a first end to a second end, wherein the first end is joined to the annular wall by a reinforcing wall, while the second end is free.

15. A dispensing head according to claim 14, wherein the reinforcing wall has a decreasing thickness towards the annular wall.

16. A dispensing head according to claim 14, wherein, at the third tab, the main skirt has a third window through the annular wall and the third tab is located inside the third window.

17. A dispensing head according to claim 16, wherein the reinforcing wall meets a lower edge of the third window in an intermediate position between the ends.

* * * * *